US007354284B2

(12) United States Patent
Aime et al.

(10) Patent No.: US 7,354,284 B2
(45) Date of Patent: Apr. 8, 2008

(54) ELECTRICAL CONNECTOR WITH CLOSURE ELEMENTS

(75) Inventors: Ugo Aime, Poirino (IT); Giovanni Turco, Turin (IT)

(73) Assignee: Tyco Electronics AMP Italia S.p.A., Collegno, TO (IT)

( * ) Notice: Subject to any disclaimer, the term of this patent is extended or adjusted under 35 U.S.C. 154(b) by 0 days.

(21) Appl. No.: 11/692,892

(22) Filed: Mar. 28, 2007

(65) Prior Publication Data

US 2007/0232148 A1 Oct. 4, 2007

(30) Foreign Application Priority Data

Mar. 28, 2006 (IT) ..... TO2006A0228

(51) Int. Cl.
*H01R 13/44* (2006.01)

(52) U.S. Cl. ..... 439/148; 439/149

(58) Field of Classification Search ..... 439/148, 439/149, 133, 135, 150
See application file for complete search history.

(56) References Cited

U.S. PATENT DOCUMENTS 4,445,738 A * 5/1984 Wiencke ..... 439/133
4,469,386 A * 9/1984 Ackerman ..... 439/133
4,546,688 A * 10/1985 Cuccio ..... 84/327
4,886,471 A * 12/1989 Fleshman Jr. ..... 439/587
5,704,796 A * 1/1998 Swenson ..... 439/148
5,947,755 A * 9/1999 Conway ..... 439/148
6,485,332 B1 * 11/2002 Kwang ..... 439/587
6,790,084 B1 * 9/2004 Osborn et al. ..... 439/587
7,150,638 B1 * 12/2006 Fonville et al. ..... 439/148
2002/0123255 A1 * 9/2002 Kertesz ..... 439/135
2005/0208833 A1 * 9/2005 Oksengorn ..... 439/620
2006/0148287 A1 * 7/2006 Zahnen et al. ..... 439/135
2007/0020977 A1 * 1/2007 Abbott ..... 439/133

FOREIGN PATENT DOCUMENTS

DE 4025571 A1 2/1992

* cited by examiner

*Primary Examiner*—Tulsidas C. Patel
*Assistant Examiner*—Harshad C Patel
(74) *Attorney, Agent, or Firm*—Barley Snyder LLC

(57) ABSTRACT

An electrical connector having a body with a central portion and a front portion, a tubular body extending from the central portion to the front portion, the tubular body defining a cavity, an electrical contact at least partially housed within the cavity, and a closure element configured for insertion into the cavity such that the electrical contact cannot be accessed from outside the electrical connector is disclosed.

11 Claims, 6 Drawing Sheets

FIG. 1
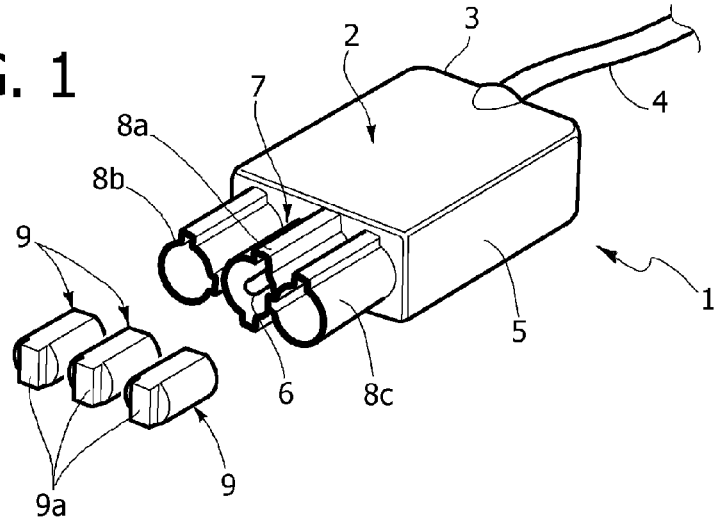
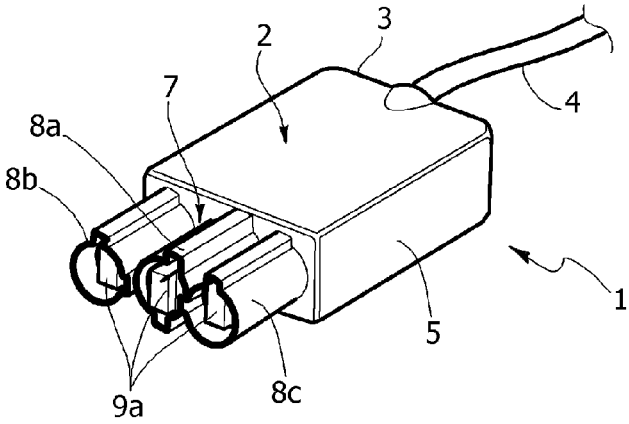
FIG. 2
FIG. 3
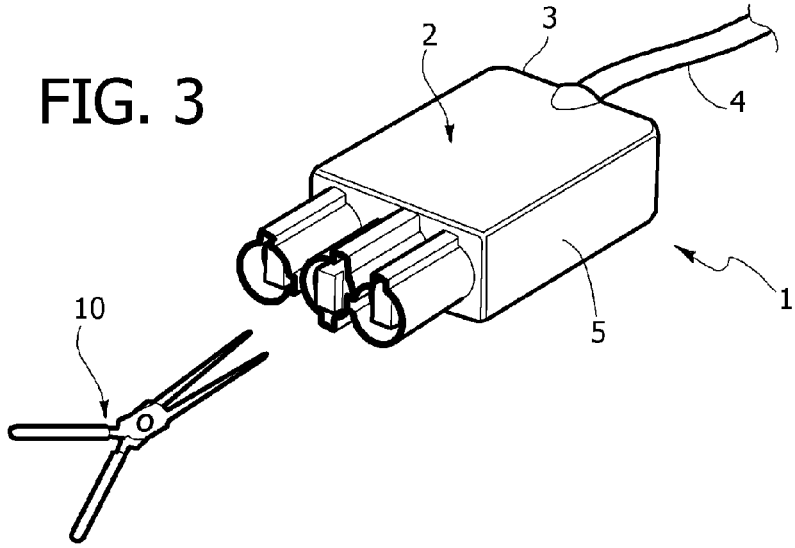

FIG. 4
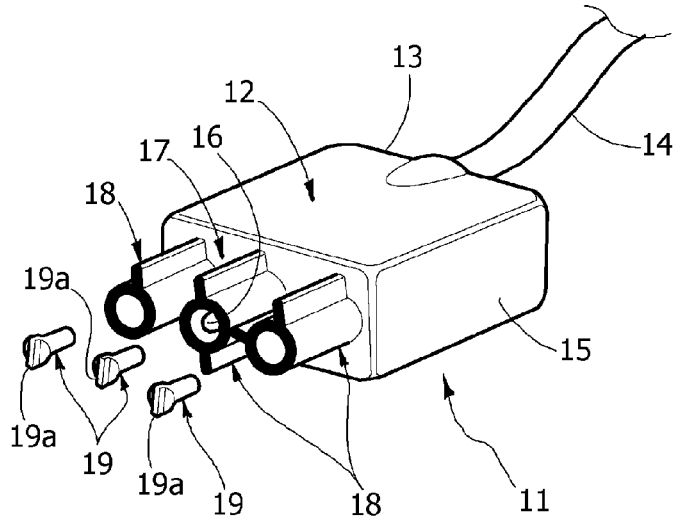
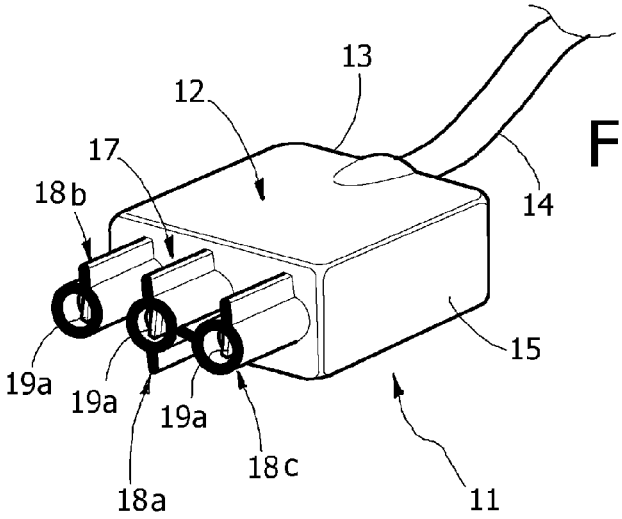
FIG. 5
FIG. 6
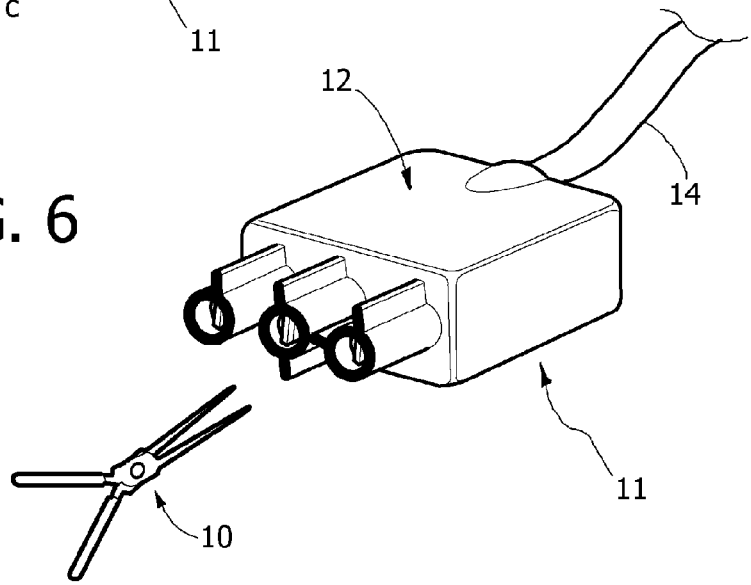

ELECTRICAL CONNECTOR WITH CLOSURE ELEMENTS

CROSS-REFERENCE TO RELATED APPLICATIONS

This application claims the benefit of the filing date under 35 U.S.C. §119(a)-(d) of Italian Patent Application No. TO2006A000228; filed Mar. 28, 2006.

FIELD OF THE INVENTION

The present invention relates to electrical connectors and more particularly to electrical connectors having closure elements for restricting access to contacts of the electrical connectors.

BACKGROUND

Document DE-A-40 25 571 discloses an electrical connector comprising a body of plastic material which has a rear portion, for receiving a wire, a central portion for connecting the wire to a plurality of electrical contacts, and a front portion, wherein said front portion comprises a plurality of substantially tubular bodies, wherein said tubular bodies extend starting from the central portion of said body and define a plurality of cavities, and wherein each cavity is provided for housing one of said electrical contacts.

However, since the electrical contacts can be easily accessed from the outside of the connector, the connectors previously disclosed and above-described do not satisfy the increasingly demanding safety requirements which are provided by present regulations.

SUMMARY

The present invention relates to an electrical connector having a body with a central portion and a front portion, a tubular body extending from the central portion to the front portion, the tubular body defining a cavity, an electrical contact at least partially housed within the cavity, and a closure element configured for insertion into the cavity such that the electrical contact cannot be accessed from outside the electrical connector.

BRIEF DESCRIPTION OF THE DRAWINGS

The invention is explained in greater detail below with reference to the accompanying Figures of which:

FIG. 1 is an oblique view of a receptacle-type electrical connector according to the present invention configured with three closure elements extracted from the electrical connector;

FIG. 2 is another oblique view of the electrical connector of FIG. 1 configured with the closure elements inserted into the electrical connector;

FIG. 3 is another oblique view of the electrical connector of FIG. 1 configured with the closure elements inserted into the electrical connector and showing a tool for extracting the closure elements;

FIG. 4 is an oblique view of a plug-type electrical connector according to the present invention configured with three closure elements extracted from the electrical connector;

FIG. 5 is another oblique view of the electrical connector of FIG. 4 configured with the closure elements inserted into the electrical connector;

FIG. 6 is another oblique view of the electrical connector of FIG. 4 configured with the closure elements inserted into the electrical connector and showing a tool for extracting the closure elements;

DETAILED DESCRIPTION OF THE EMBODIMENTS

Figure 7:
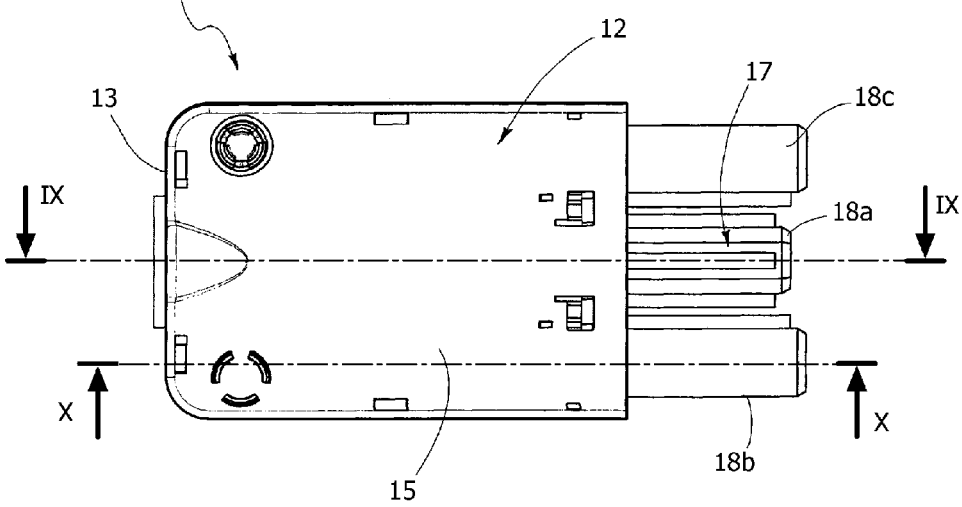
FIG. 7 is an orthogonal view of the plug-type electrical connector of FIG. 4.

With reference to FIGS. 1-3, a receptacle-type electrical connector is generally designated by reference number 1. The electrical connector 1 comprises a body 2 of plastic material which has a rear portion 3 for receiving a wire 4, and a central portion 5 for connecting the wire 4 to three electrical contacts 6. In the case of the receptacle-type electrical connector 1, the electrical contacts 6 are plug-type contacts, and in FIG. 1 only the central contact 6 is visible which is the earth or ground contact.

The body 2 of plastic material further comprises a front portion 7 which includes three substantially tubular bodies 8. The tubular bodies 8 extend from the central portion 5 of the body 2 of plastic material and define three cavities, in which the three plug-type electrical contacts 6 are housed.

With particular reference to FIG. 1, three closure elements 9 are associated to the electrical connector 1 and can be inserted into the above-mentioned three cavities defined by the three tubular bodies 8. Each closure element 9 is shaped so that, once it has been inserted into one of the three cavities, it closes the cavity whereby the respective plug-type electrical contact 6 is no longer accessible from the outside.

A plug-type electrical connector 11, shown in FIGS. 4-6, comprises a body 12 of plastic material which has a rear portion 13 for receiving a wire 14. The body 12 of plastic material further comprises a central portion 15 for connecting the wire 14 to three receptacle-type electrical contacts 16. The body 12 of plastic material further comprises a front portion 17 which includes three substantially tubular bodies 18 which extend from the central portion 15 of the body 12 of plastic material. The three tubular bodies 18 define three cavities for housing the above-mentioned receptacle-type electrical contacts 16.

As shown in particular in FIG. 4, to the plug-type electrical connector 11 there are associated three closure elements 19 which can be inserted into the above mentioned cavities defined by the tubular bodies 18.

Each closure element 19 is shaped, so that once it has been inserted into one cavity as defined by the tubular bodies 18, it closes the above-mentioned cavity so that the respective receptacle-type electrical contact 16 is not accessible from the outside.

The closure elements 9 and 19 are shaped so that, once they have been inserted into the respective cavities, they do not have parts projecting outwardly from the respective tubular bodies 8 and 18 (see FIGS. 2 and 5).

With particular reference to FIGS. 1 and 4, the closure elements 9 and 19 have a terminal gripping portion respectively designated by 9*a* and 19*a*.

From FIGS. 2 and 5 it can be noted that the shape and the dimension of the above-mentioned terminal gripping portions 9*a*, 19*a*, relative to the dimension of the cavities defined by three tubular bodied 8 and 18, are such that they prevent the closure elements 9 and 19 from being extracted from the cavities using only the fingers of a hand. Instead, the closure elements must be extracted with the aid of a tool 10 such as pliers (see FIGS. 3 and 6).

Due to the configuration of the closure elements 9 and 19, a high degree of safety is ensured since the closure elements 9, 19 prevent the electrical contacts 6, 16 inside the electrical connectors 1, 11 from being accessed from the outside and further prevent extraction of the closure elements 9, 19 using only the fingers of a hand.

FIG. 7 shows a plug-type electrical connector 11, in which it can be noted that the three tubular bodies 18 have different lengths, and in particular, the central tubular body 18*a* is shorter than the lateral tubular bodies 18*b* and 18*c*.

Figure 9:
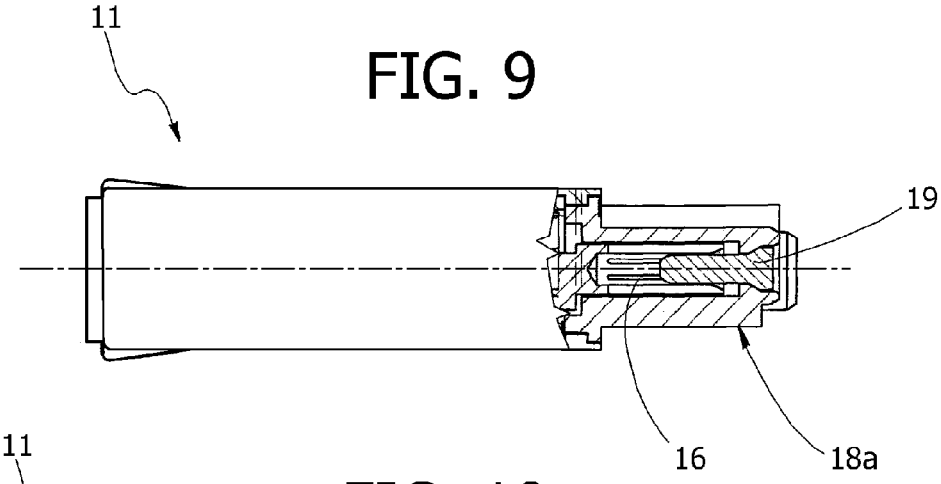
FIG. 9 is a partially cross-sectional view of the plug-type electrical connector of FIG. 4 taken along line IX-IX of FIG. 7.
Figure 10:
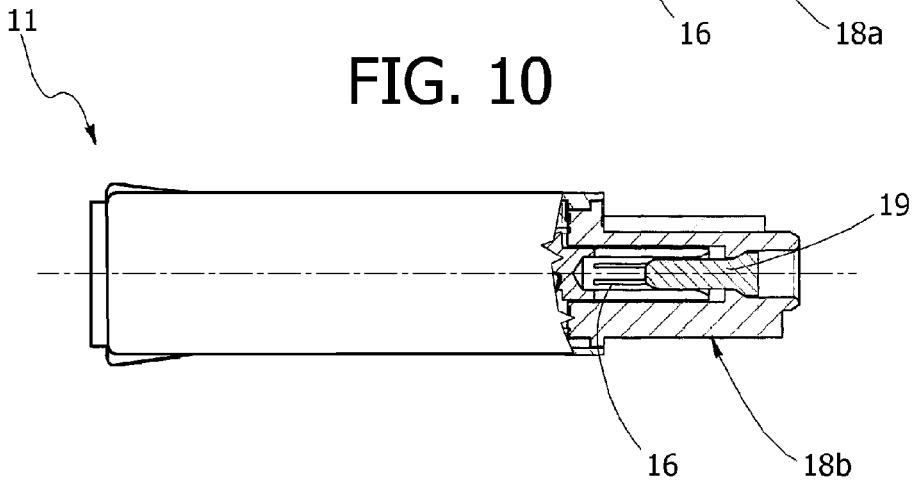
FIG. 10 is a partially cross-sectional view of the plug-type electrical connector of FIG. 4 taken along line X-X of FIG. 7.

FIG. 9 and FIG. 10 show cross-sections of the central tubular body 18*a* and the lateral tubular body 18*b*, respectively. FIGS. 9 and 10 relate to the configuration in which the closure elements 19 are inserted into the receptacle-type electrical contacts 16. It can be noted from FIG. 9 that the closure element 19 is inserted into the cavity defined by the tubular 18*a* and contacts the tabs of the receptacle-type electrical contact 16. However, with reference to FIG. 10, it can be noted that the closure element 19 appears to be more deeply inserted as compared to the example of FIG. 9, since the tubular body 18*b* is longer than the tubular body 18*a*.

Figure 8:
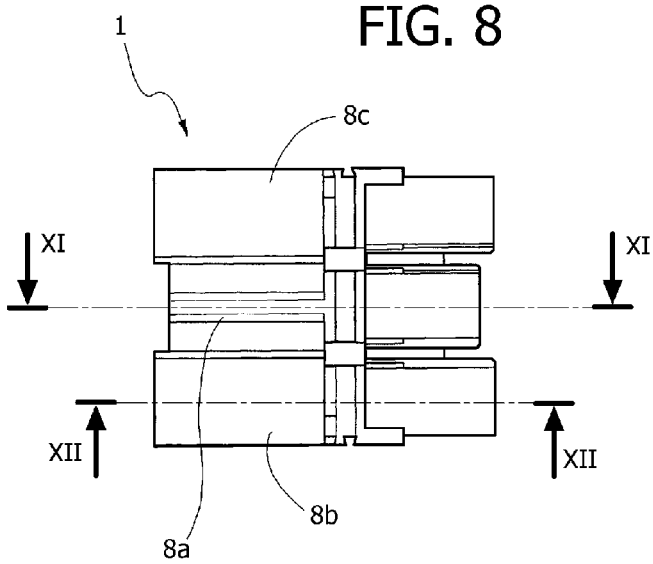
FIG. 8 is a plan view of the receptacle-type electrical connector of FIG. 1.

FIG. 8 shows a receptacle-type connector 1 where it can be noted that the tubular body 8*a* has a shorter length with respect with the lateral tubular bodies 8*b* and 8*c*.

Figure 11:
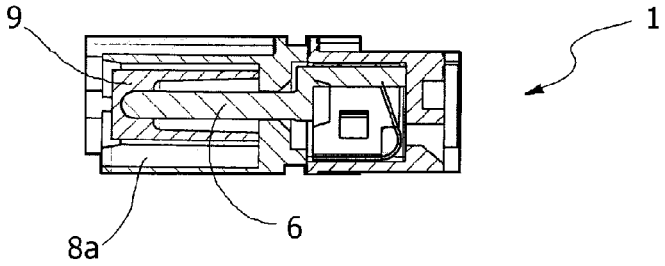
FIG. 11 is a partially cross-sectional view of the receptacle-type electrical connector of FIG. 1 taken along line XI-XI of FIG. 8.
Figure 12:
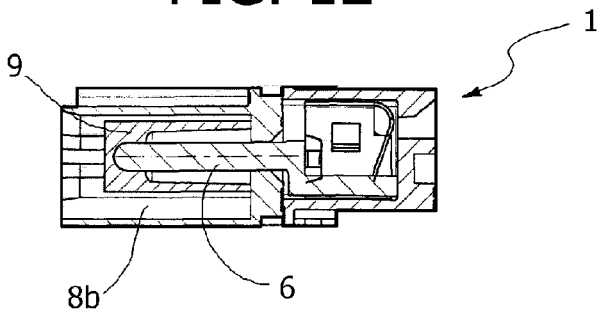
FIG. 12 is a partially cross-sectional view of the receptacle-type electrical connector of FIG. 1 taken along line XII-XII of FIG. 8.

FIG. 11 and FIG. 12 refer to the configuration in which the closure elements 9 are inserted into the above-mentioned cavities defined by the tubular bodies 8. Also in this case, in FIG. 12 the closure element 9 is arranged at a position more deeply inserted as compared to FIG. 11. This happens because FIG. 12 depicts the tubular body 8*b*, whereas FIG. 11 depicts the central tubular body 8*a*, which is shorter.

Figure 13:
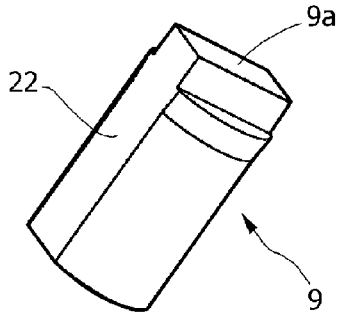
FIG. 13 is an oblique view of the closure element associated with the receptacle-type connector of FIG. 1.
Figure 14:
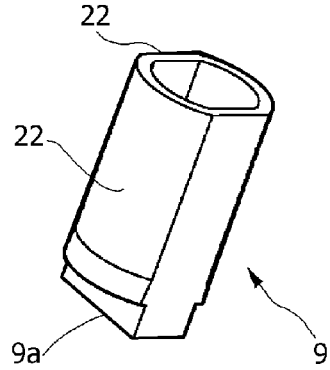
FIG. 14 is another oblique view of the closure element associated with the receptacle-type connector of FIG. 1.

FIGS. 13 and 14 show different views of a closure element 9. The closure element 9 is the closure element which is provided for association with the receptacle-type connector 1 and has a substantially cap-like cylindrical shape with a bottom wall on which the terminal gripping portion 9*a* is formed.

Figure 15:
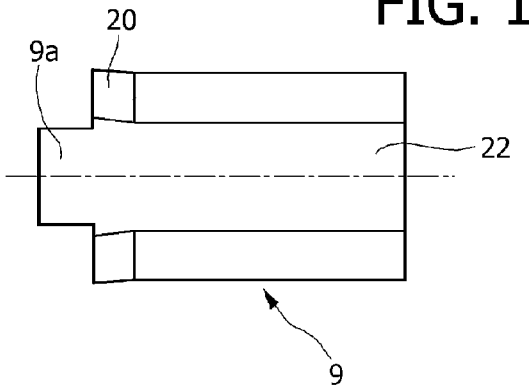
FIG. 15 is an orthogonal view of the closure element associated with the receptacle-type connector of FIG. 1.

The closure element 9 can be inserted into a respective cavity defined by one of the tubular bodies 8 and over the respective plug-type contact 6. In FIG. 15, the cap-like cylindrical closure element 9 has a flare 20, adjacent to the terminal gripping portion 9*a*, with a slightly increased outer diameter, so as to ensure a friction locking relative to the inner wall of the respective cavity defined by the respective tubular body 8.

Figure 16:
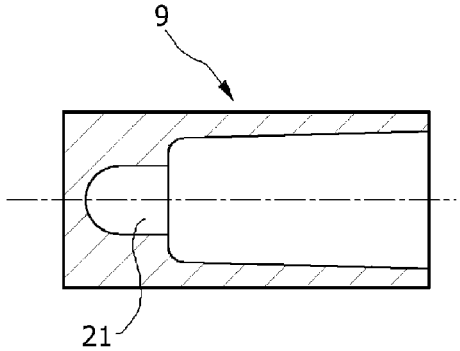
FIG. 16 is a cross-sectional view of the closure element associated with the receptacle-type connector of FIG. 1 taken along line XVI-XVI of FIG. 15.

The cap-like cylindrical closure element 9 has an inner cavity with an end part 21 (see FIG. 16) adjacent to the bottom wall, having a slightly smaller diameter with respect to the diameter of the plug-type electrical contact 6, so as to ensure a friction locking relative to the plug-electrical contact 6. This configuration of the closure element 9 provides a double friction locking action, one friction locking action relative to the inner wall of the cavity and the other friction locking action relative to the electrical contact 6.

Figure 17:
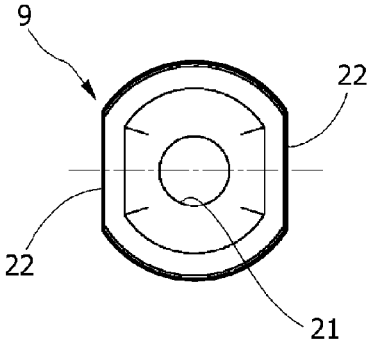
FIG. 17 is another orthogonal view of the closure element associated with the receptacle-type connector of FIG. 1.
Figure 18:
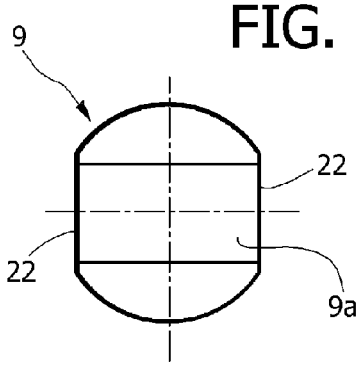
FIG. 18 is another orthogonal view of the closure element associated with the receptacle-type connector of FIG. 1.

With reference to FIGS. 15, 17, 18 the cap-like cylindrical closure element 9 has two flat faces 22 on its outer surface, which are diametrically opposite each other and extend the longitudinal direction so as to define a non-circular cross-section of the cap-like element. In this manner, a shape coupling is possible between the cap-like closure element 9 and the respective substantially tubular body 8 of the receptacle-type connector 1, which has a complementary shape (see for example FIG. 1).

The terminal gripping portion 9*a* of the closure element 9 is defined by an axially projecting ridge, visible in FIG. 15, which extends from the bottom wall and in a direction transverse to the planes of faces 22.

Figure 19:
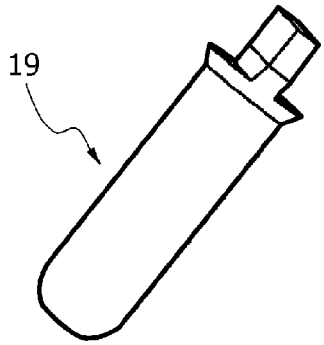
FIG. 19 is an oblique view of the closure element associated with the plug-type connector of FIG. 4.
Figure 20:
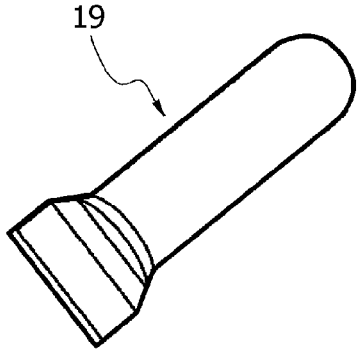
FIG. 20 is another oblique view of the closure element associated with the plug-type connector of FIG. 4.

In FIGS. 19 and 20 a closure element 19 for association with the plug-type connector 11 is shown in different views. The closure element 19 comprises a body substantially in the form of a pin which is inserted into the respective receptacle-type contact 16 so as to prevent the contact from being accessible from the outside.

Figure 21:
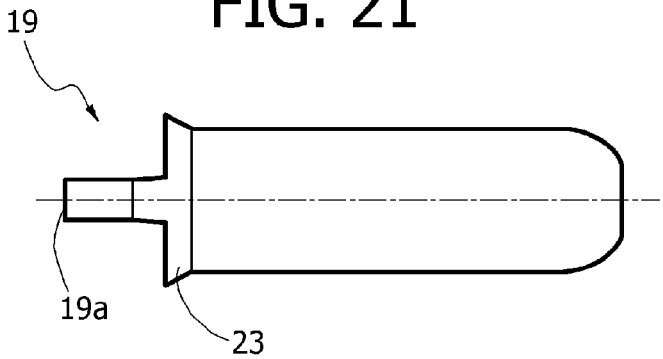
FIG. 21 is an orthogonal view of the closure element associated with the plug-type connector of FIG. 4.

With reference to FIG. 21, the pin-like closure element 19 has a flare 23 adjacent to the terminal gripping portion 19*a* having a slightly greater diameter as compared to the diameter of the receptacle-type contact 16, so as to prevent the closure element 19 from being completely inserted to the above mentioned receptacle-type contact 16, ensuring the possibility of it subsequently being extracted. In this case, the locking action is provided by the elasticity of the receptacle-type contact 16, which comprises a number of tabs which are elastically deformed upon the insertion of the closure element 19 and hold the latter in position.

Figure 22:
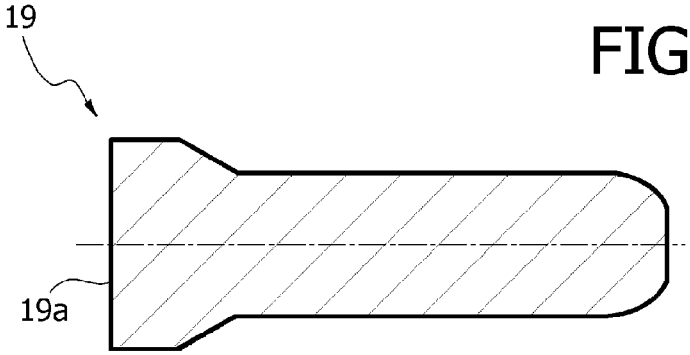
FIG. 22 is a cross-sectional view of the closure element associated with the plug-type connector of FIG. 4 taken along line XXII-XXII of FIG. 21.
Figure 23:
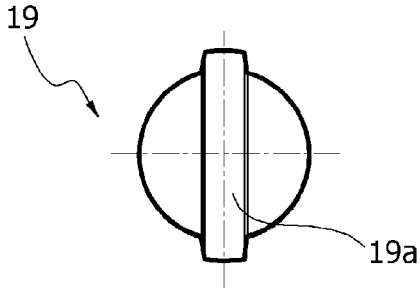
FIG. 23 is another orthogonal view of the closure element associated with the plug-type connector of FIG. 4.

The terminal gripping portion 19*a* of the closure element 19 is defined by an axially projecting tab which extends from the gripping end of the pin-like closure element 19 (see FIGS. 22 and 23).

As clearly apparent from the foregoing description, the electrical connector provided with the closure elements according to the invention offers a greater degree of safety with respect to the known connectors.

Naturally, while the principle of the invention remains the same, the details of construction and the embodiments may widely vary with respect to what has been described and shown purely by way of example, without departing from the scope of the present invention.

What is claimed is:

1. An electrical connector, comprising:

a body having a central portion and a front portion;

a tubular body extending from the central portion to the front portion, the tubular body defining a cavity;

an electrical contact at least partially housed within the cavity; and a closure element configured for insertion into the cavity such that the electrical contact cannot be accessed from outside the electrical connector, the closure element being sized and shaped so that the closure element does not protrude from the tubular body after insertion into the cavity.

2. The electrical connector according to claim 1, the closure element further comprising:

a terminal gripping element.

3. The electrical connector according to claim 2, wherein the terminal gripping element is sized and shaped with respect to the cavity so that the closure element may not be removed only using the fingers of a hand but the closure element may be removed using a tool.

4. The electrical connector according to claim 3, wherein the electrical connector is a receptacle-type connector, the electrical contact is a plug-type contact, and the closure element is substantially cap-shaped, and is configured for insertion into the cavity and over the plug-type contact.

5. The electrical connector according to claim 4, the closure element further comprising:

a flare adjacent to the terminal gripping portion, the flare having an increased outer diameter to ensure friction locking between the closure element and an inner wall of the cavity.

6. The electrical connector according to claim 4, the closure element further comprising:

an end part having a decreased diameter with respect to the electrical contact to ensure friction locking between the closure element and the electrical contact.

7. The electrical connector according to claim 4, the closure element further comprising:

two flat faces on the outer surface of the closure element.

8. The electrical connector according to claim 7, wherein the terminal gripping portion comprises an axially projecting ridge which extends in a direction transverse with respect to the planes of the flat faces.

9. The electrical connector according to claim 3, wherein the electrical connector is a plug-type connector, the electrical contact is a receptacle-type contact, and the closure element is substantially pin-shaped, and is configured for insertion into the receptacle-type contact.

10. The electrical connector according to claim 9, the closure element further comprising:

a flare adjacent to the terminal gripping portion, the flare having an increased outer diameter with respect to the diameter of the receptacle-type electrical contact to prevent complete insertion of the closure element into the receptacle-type electrical contact.

11. The electrical connector according to claim 10, wherein the terminal gripping portion comprises an axially projecting tab.

* * * * *